US009352246B2

(12) United States Patent
Roux

(10) Patent No.: US 9,352,246 B2
(45) Date of Patent: May 31, 2016

(54) EVAPORATION DEVICE

(75) Inventor: Jean-Maxime Roux, Grenoble (FR)

(73) Assignee: Commissariat a l'Energie Atomique et aux Energies Alternatives, Paris (FR)

( * ) Notice: Subject to any disclaimer, the term of this patent is extended or adjusted under 35 U.S.C. 154(b) by 838 days.

(21) Appl. No.: 13/303,916

(22) Filed: Nov. 23, 2011

(65) Prior Publication Data

US 2012/0161747 A1 Jun. 28, 2012

(30) Foreign Application Priority Data

Nov. 26, 2010 (FR) ..... 10 04598

(51) Int. Cl.
*B01B 1/00* (2006.01)

(52) U.S. Cl.
CPC ..... *B01B 1/005* (2013.01)

(58) Field of Classification Search
USPC ..... 392/386, 488; 417/208; 324/71.4; 431/11, 208, 32, 206, 241
See application file for complete search history.

(56) References Cited

U.S. PATENT DOCUMENTS 3,524,773 A * 8/1970 Cermak ..... 136/224
4,318,689 A * 3/1982 Forster ..... F23D 11/441 392/471
6,347,936 B1 * 2/2002 Young et al. ..... 431/11
6,863,117 B2 * 3/2005 Valenzuela ..... F28D 15/0233 165/104.21
6,972,145 B1 * 12/2005 Ruid et al. ..... 428/71
7,431,570 B2 * 10/2008 Young et al. ..... 417/208
7,437,908 B2 * 10/2008 Bae et al. ..... 73/28.02
7,775,261 B2 * 8/2010 Valenzuela ..... F28D 15/0233 165/104.21
7,942,644 B2 * 5/2011 Young et al. ..... 417/208
8,034,452 B2 * 10/2011 Padiyath et al. ..... 428/408
8,813,744 B2 * 8/2014 Chen et al. ..... 128/203.26
2005/0006309 A1 * 1/2005 Effenhauser et al. ..... 210/637
2006/0196968 A1 * 9/2006 Rabin et al. ..... 239/136
2007/0151518 A1 * 7/2007 Kato ..... 118/726
2007/0193533 A1 8/2007 Kanda et al.
2009/0220222 A1 * 9/2009 Rabin ..... A01M 1/2077 392/396
2010/0142934 A1 * 6/2010 Sellers ..... F22B 1/28 392/387

FOREIGN PATENT DOCUMENTS

DE 19860227 C1 5/2000
DE 102007006217 A1 8/2008
WO WO-2005/049185 A1 6/2005
WO WO-2007/012447 A1 2/2007

OTHER PUBLICATIONS

"European Application No. 11 18 8935, European Search Report dated Mar. 1, 2012", 2 pgs.

* cited by examiner

*Primary Examiner* — Dana Ross
*Assistant Examiner* — Renee L Miller
(74) *Attorney, Agent, or Firm* — The Dobrusin Law Firm P.C.

(57) ABSTRACT

The present invention relates to a device for the vaporization of a liquid, said device comprising: a reservoir capable of containing a liquid to be vaporized, a heating element capable of heating the liquid in order to vaporize the liquid, a capillary pump capable of pumping the liquid contained in said reservoir to said heating element by capillary pumping, and a capillary barrier arranged along a capillary pumping direction of the liquid to be vaporized downstream from the capillary pump, said capillary barrier being capable of preventing the non-vaporized liquid from escaping from the device.

20 Claims, 3 Drawing Sheets

EVAPORATION DEVICE

CLAIM OF PRIORITY

This patent application claims the benefit of priority, under 35 U.S.C. §119, French Patent Application No. 10/04598, entitled "DISPOSITIF D'ÉVAPORATION," filed on 26 Nov. 2010, which is hereby incorporated by reference herein in its entirety.

The present invention relates to an evaporation device comprising an improved capillary pump for the production of vapor intended for a variety of applications and, more particularly, a device for vaporizing a liquid comprising a reservoir capable of containing a liquid to be vaporized, a heating element capable of heating the liquid in order to vaporize the liquid, and a capillary pump capable of pumping the liquid contained in said reservoir to said heating element by capillary pumping.

TECHNICAL FIELD AND PRIOR ART

International application WO 2005/049185 describes such a vaporization device comprising a capillary pump intended for the production and emission of pressurized and non-pressurized vapor from a liquid to be vaporized. More particularly, international application WO 2005/049185 describes a device utilizing a capillary pump having for the capillary pumping a wettable porous medium enabling a liquid to be vaporized to be passively pumped from a reservoir to a heating or heated element. In its simplest form, this device comprises a liquid to be vaporized inlet, a porous vaporization element and an element for thermal transfer. Other elements such as an insulating element, an element enabling the liquid to be vaporized to be preheated, a liquid supply reservoir and/or a supply system, an integrated or associated heating element, a vapor accumulation chamber, a heat distributor, an opening and/or vapor emission element, may be associated or integrated with this device.

Nevertheless, vaporization devices comprising a capillary pump according to the prior art present numerous disadvantages. For example, even if the capillary pumping performed by the capillary pump provided in the device according to international application WO 2005/049185 is independent from the orientation of said device, a leakage will occur and the liquid contained in the reservoir will flow out in the case where the device is utilized the wrong way, i.e., with the liquid supply reservoir reversed above the capillary pump. Another leakage will occur since the wettable porous medium making said capillary pump may limit, the flow rate, but cannot stop it.

The object of the present invention thus is to remedy these disadvantages by proposing a device for the vaporization of a liquid comprising a capillary pump capable of operating without leakage whatever the orientation of the pump while consuming minimal electrical power during operation.

SUMMARY OF THE INVENTION

Devices for the vaporization of a liquid according to the present invention are provided for the emission of vapor produced from a liquid to be vaporized. During operation of such a device, a liquid to be vaporized, generally having a first temperature and being provided in a low pressure liquid supply reservoir, is pumped by means of a capillary pump through capillary forces. The liquid thus pumped is transported to an area of the device that is used as a vaporizer. This area is equipped with a capillary barrier that is impermeable to liquid and permeable to steam, thus defining a liquid/vapor interface or liquid/gas interface. The liquid migrating to this interface is heated to a second temperature, higher than the first temperature, and is vaporized. The liquid-impermeable and vapor-permeable capillary barrier enables the vapor to be expelled from the device.

More particularly, devices for the vaporization of a liquid to be vaporized according to the present invention comprise a reservoir capable of containing a liquid to be vaporized, a heating element capable of heating the liquid in order to vaporize the liquid, a capillary pump capable of pumping the liquid contained in said reservoir to said heating element by capillary pumping, and a capillary barrier arranged along a capillary pumping direction of the liquid to be vaporized downstream from the capillary pump, said capillary barrier being capable of preventing the non-vaporized liquid from escaping from the device.

The present invention thus proposes compact devices enabling high integration and preventing any leakage of liquids independently from the orientation of the devices during use.

According to an embodiment, said capillary barrier comprises at least one non-wettable porous component. Said at least one non-wettable porous component is preferably impermeable to said liquid to be vaporized and permeable to the vapor generated from said liquid to be vaporized.

Thus, the desired leakproofness of the devices according to the present invention may be obtained by utilizing a simple and inexpensive component.

Said at least one non-wettable porous component preferably comprises a membrane in a polymer material.

Thus, a sturdy and reliable non-wettable porous component may be proposed.

According to an embodiment, said at least one non-wettable porous component is a comparatively poor conductor of the heat required for vaporizing said liquid to be vaporized. Preferably, said at least one non-wettable porous component is adapted to withstand temperatures greater than the liquid vaporization temperature, for example 100° C. for water at atmospheric pressure, and/or comprises a thermally insulating material.

The present invention thus enables the capillary barrier to be close to the heating element, thus enabling high integration of the device for the vaporization of a liquid to be vaporized and the availability of a compact, strong and solid device.

Said capillary barrier is preferably arranged in a removable manner.

Thus, the capillary barrier may be easily and quickly exchanged or cleaned, thus enabling improved salubrity of the device. In further detail, when the device is utilized for the vaporization of a liquid to be vaporized according to the present invention, for example in an air analysis system, the capillary barrier may be situated inside the analysis system and in contact with the air to be treated, while being exchangeable between two successive analyses thanks to its removability. Thus, the risk of contamination of the analysis system, that may distort the results obtained, may be easily and effectively eliminated.

According to an embodiment, said reservoir, said capillary pump and said capillary barrier are provided in the form of stacked disks. Alternately, at least said capillary pump may be provided in cylindrical form and said capillary barrier in annular form, said capillary barrier at least partially surrounding said capillary pump.

Thus, a compact and rigid device for the vaporization of a liquid to be vaporized may be obtained.

Said reservoir, said capillary pump and said capillary barrier are preferably arranged in an external support. Said external support preferably comprises glass, ceramic and/or plastic adapted to withstand the heat required for the vaporization of said liquid to be vaporized. In addition, such materials present low thermal conductivity, which minimizes thermal energy losses: Then the energy consumption of the device is minimized.

Thus, an inexpensive external support may be proposed, adapted for safely and solidly maintaining the constituent components of the device for the vaporization of a liquid to be vaporized according to the present invention in a predefined structure.

According to an embodiment, said heating element comprises at least one unoxydizable material. Preferably, said heating element is arranged in a direction of capillary pumping of said liquid to be vaporized between said capillary pump and said capillary barrier. Alternately, said heating element may be arranged in a direction of capillary pumping of said liquid to be vaporized downstream from said capillary barrier.

The present invention thus may have a reliable heating element at a location of the device for the vaporization of a liquid to be vaporized in the vicinity of which the vaporization of the liquid will take place. Thus, the heat required for the vaporization may be produced exactly at the location of the vaporization, thus enabling minimized electrical power consumption by the heating element, and, thus, by the device during operation.

Said heating element is preferably provided in the form of an electrically conductive grid.

Thus, a simple and effective heating element may be produced.

According to an embodiment, said capillary pump comprises at least one wettable porous component that is permeable to said liquid to be vaporized. The porosity of said at least one non-wettable porous component may be higher than the porosity of said at least one wettable porous component. This enables a facilitated evacuation of the vapor. But the porosity of said at least one non-wettable porous component may also be lower than the porosity of said at least one wettable porous component. This will particularly be the case if one wishes that the non-wettable porous component constitute a barrier preventing pollution of the device by the external environment, for example bacteriological pollution.

Thus, a functional and reliable capillary pump may be proposed.

Said at least one wettable porous component may be equipped with a porosity gradient, or comprise at least one first porous component and one second porous component, the porosity of said first porous component being higher than the porosity of said second porous component. It is known that a decreasing porosity gradient, obtained by reducing pore diameter, along the liquid pumping direction, increases the pumping pressure.

Thus, a simple, sturdy and effective wettable porous component may be proposed.

It is to be noted that devices for the vaporization of a liquid to be vaporized according to the present invention may vaporize any type of liquid, provided that it can be vaporized under suitable conditions, for example a required vaporization heat and an associated boiling point. Liquids to be vaporized may comprise water, ethanol, perfume compounds, crop treatments, insect repelling and/or attracting products, antiseptics, inhalants and other medical compositions, as well as other liquids for which vaporization is desirable and/or necessary in order to allow, for example, precise dosing of a vapor such as in a process for producing or depositing a chemical vapor. The advantages of a utilization of devices for vaporizing a liquid to be vaporized according to the present invention for vaporizing liquids are that the vapor may be produced from top to bottom of the device and driven by air flow. Thus, the reservoir containing liquid may be situated above an associated evaporation area, so the hydrostatic pressure is substituted at the mechanical pumps and pressurization systems. In addition, the wettable porous components ensure uniform feeding of the heating element if the device is tilted. Lastly, the external body of the device has a simple geometry, so that it is easy to clean.

An example of embodiment and application of a device for vaporizing a liquid to be vaporized according to the present invention as described above is a counter and/or collector of particles included in a gas to be treated, such as air, for example a particle counter and/or collector by semi-humid electrostatic collection. In such counters or collectors, the air to be treated is sometimes enriched or even saturated in vapor so as to cause the particles to grow by nucleation, either for counting purposes for the counters via optical means, or for collection purposes for the collectors. The present invention may be integrated in such apparatuses and improve them by its advantages over apparatuses from the prior art. An electrostatic collector device is for example described in application WO 2007/012447. The vapor generator according to the invention may be utilized as a vapor production means for such an electrostatic collector.

For example, a semi-humid particle collector requires the enrichment of air in water vapor for

- causing the particles to be collected to grow and thus facilitate their collection in an intense electrical field,
- forming a liquid film on a wall, that flows by gravity and carries the particles to be collected to an analysis system.

By combining a device for the vaporization of liquid to be vaporized according to the present invention such as described above with such a semi-humid particle collector, it would be possible to exploit the flow of air to forge the flow of the liquid film on the wall and thus orient the collector differently. In other words, instead of having a flow of air and vapor from the bottom to the top, it would be possible to orient the air and vapor flows from the top to the bottom by utilizing a device for the vaporization of a liquid to be vaporized according to the present invention.

Nevertheless, it should be noted that the utilization of the device for the vaporization of a liquid to be vaporized according to the present invention for producing a particle counter and/or collector was only described for illustration without restricting the device to such a utilization. On the contrary, a utilization of the device in many different applications is possible, such as for example a utilization for producing an apparatus for treating the respiratory tract by humidified air.

DETAILED DESCRIPTION OF THE INVENTION

Figure 1:
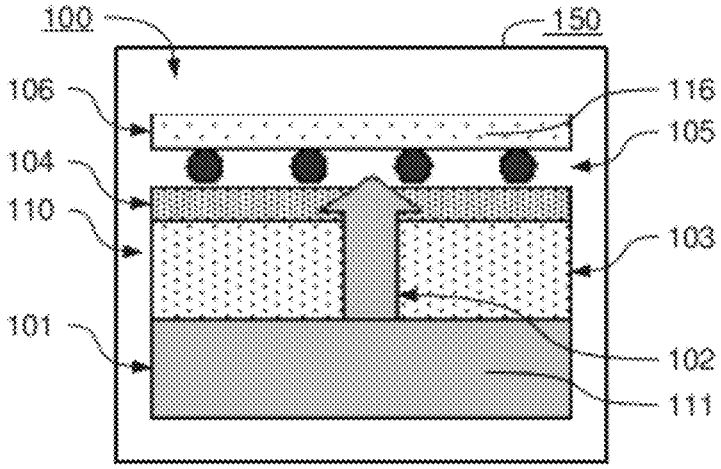
FIG. 1 is a schematic diagram in side view illustrating a particle counter and/or collector by semi-humid electrostatic collection comprising a device for the vaporization of a liquid to be vaporized according to an embodiment of the present invention.

FIG. 1 shows a particle counter and/or collector by semi-humid electrostatic collection 150 comprising a device for the vaporization of a liquid to be vaporized 100 according to a first embodiment of the present invention. An exemplary configuration of a particle counter and/or collector by semi-humid electrostatic collection is described in international application WO 2007/012447, the content of which is explicitly referred to and considered as being an integral part of the present application. The counter and/or collector 150 differs from the counter and/or collector of international application WO 2007/012447 essentially by the constitution of its device for the vaporization of a liquid to be vaporized 100. Thus, below only device 100 is described in further detail, for the sake of brevity and simplicity of the description.

The device for the vaporization of a liquid to be vaporized 100 comprises, by may of example, a configuration in the form of stacked disks. When device 100 is operated, a liquid is pumped by one or more capillary pumping layers and is then vaporized. The vapor produced is expelled or emitted under pressurized or essentially non-pressurized conditions and may be utilized directly. For simplicity of the description below, device 100 is later also designated as an "evaporation device."

Evaporation device 100 comprises, for the illustration, a reservoir 101 capable of containing a liquid to be vaporized 111, a heating element 105 capable of heating the liquid in order to vaporize it, a capillary pump 110 capable of pumping the liquid contained in reservoir 101 to the heating element 105 by capillary pumping, and a capillary barrier 106 arranged in a direction 102 of capillary pumping of the liquid to be vaporized 111 downstream from the capillary pump 110. According to the invention, the capillary barrier 106 is capable of preventing the non-vaporized liquid from escaping from the device 100 and preferably comprises at least one non-wettable porous component 116.

The capillary pump 110 is permeable to the liquid to be vaporized 111 and comprises at least one wettable porous component 103, 104. The pore diameter of this wettable porous component 103, 104 may be larger than the pore diameter of the non-wettable porous component 116. By way of example, the capillary pump 110 comprises a first porous component 103 and a second porous component 104. The porosity of the first porous component 103 is higher than the porosity of the second porous component 104. In other words, the pores of the second wettable porous component 104 are preferably smaller than those of the first wettable porous component 103. In addition, the first wettable porous component 103 is preferably thick compared to the second wettable porous component 104 to ensure good thermal insulation between the heating element 105 and the reservoir 101 for the liquid to be vaporized 111. The liquid 111 pumping function may be ensured by capillarity provided that the capillaries or pores of the wettable porous components 103, 104 have a sufficiently small diameter, preferably less than a millimeter, from some tenths of a micron to some hundred microns. Thus, in a preferred embodiment of the invention, the first wettable porous component 103 is equipped with a porosity of some tenths of microns or even hundreds of microns and the second wettable porous component 104 is equipped with a porosity of some tenths of microns to some microns.

Nevertheless, it should be noted that the second wettable porous component 104 is purely optional. The evaporation device 100 may thus be produced according to an embodiment of the present invention without the second wettable porous component 104. In this case, the first wettable porous component 103 constitutes for example in itself the capillary pump 110 according to the present invention and is then, preferably, equipped with a porosity gradient.

When evaporation device 100 is operated, the first wettable porous component 103 and the second wettable porous component 104 ensure capillary pumping of the liquid to be vaporized 111 from the reservoir 101. A liquid pathway is established in the direction of arrow 102, and a heat circulation pathway is established in the area comprising the heating element 105.

As specified before, one of the advantages of the evaporation device 100 is that it operates passively as relating to capillary pumping and without any leakage independently of its orientation during use. However, as mentioned above, a wettable porous medium may not stop the flow of a liquid. In the situation where the evaporation device 100 is upside down, the liquid reservoir 101 is then located above the wettable porous components 103, 104, the reservoir 101 emptying drop by drop. In such a situation, the wettable porous components 103, 104 would only be used to limit, the flow rate by introducing a considerable pressure drop. To mitigate this problem, the evaporation device 100 according to the present invention comprises non wettable porous component 116. This non wettable porous component 116 is impermeable to said liquid to be vaporized 111 and is permeable to the vapor generated from said liquid to be vaporized 111. In this configuration, a liquid/vapor or liquid/air interface is blocked at the interface between the two wettable porous 103, 104 and non wettable 116 media.

In the context of the present invention, a material is called "wettable" when a drop placed on top leads to a contact angle of the triple line of less than 90° according to a commonly accepted definition. Thus, a wettable and porous material is permeable to a liquid, for example a liquid to be vaporized 111. The term "hydrophilic" is reserved for materials that are wettable in relation to water. A material is called "non wettable" when a drop placed on top leads to a contact angle of the triple line of greater than 90°. A non wettable material is generally impermeable (or not very permeable) to a liquid, for example the liquid to be vaporized 111, and may be permeable to vapor if it is porous. The term "hydrophobic" is reserved for materials that are not wettable in relation to water.

According to an embodiment, the non wettable porous component 116 comprises a membrane in a polymer material, such as for example Teflon. Preferably, the non wettable porous component 116 is a comparatively poor conductor of the heat required for the vaporization of said liquid to be vaporized 111 and is adapted to withstand vaporization temperatures, for example 100° C. for water. To do this, the non wettable porous component 116 may comprise a thermally insulating material.

Situated between the first wettable porous component 103 and the non wettable porous component 116, the heating element 105 directly heats the liquid/vapor or liquid/air interface. We clarify that the liquid/vapor interface is not necessarily situated at the level of the heating element, but may be displaced, in the porous medium 103, 104 to the reservoir 101. In further detail, the heating element 105, situated at the level of this interface or rather in the immediate vicinity of this interface, enables the liquid pumped to this interface to be vaporized. This heating element 105 is advantageously an electrically conductive grid, preferably constituted of an unoxydizable material. Heating element 105 may be equipped with, and electrically connected to, an energy source (not shown). Crossed by an electric current from this source, the element is heated by the Joule effect and heats the liquid/vapor or liquid/air interface where it is located. The energy provided is thus directly transmitted only to the location where it is necessary. In addition, by choosing porous components 103, 104 and/or 116 in materials that are poor heat conductors, the thermal energy losses are very low. Heating element 105 may for example be constituted of a grid constituted of stainless steel wires with a diameter of 100 μm, the distance between each wire being of the order of the diameter, powered by a voltage of some volts.

More generally, when an electrical energy source is available, a heating element that can be heated by electrical energy may be utilized in order to produce the heating element 105 to provide the required thermal energy for vaporization. Electric resistance-based heating elements or elements comprising a thermistor or any other heat resistant material suitable and adapted for heating, when they are traversed by an electric current, may be utilized. The heating resistant material may be designed as a wire, a porous material, a perforated sheet or a disk, or may be deposited as a thin or thick film. Preferably, it is incorporated such that the permeability with relation to the vapor at the vapor emission surface of the vaporizer component, i.e., the non wettable porous component 116, is substantially maintained. Alternately, the heat may be applied directly to the surface of the non wettable porous component 116 by using a heat resistant material, in direct contact with or directly deposited on the non wettable porous component 116.

The constituent components of the evaporation device 100 described above are sufficiently aligned to produce and maintain the liquid flow pathways so that the liquid and vapor may travel in or on the associated surfaces of various components by capillary pumping. The different wettable porous components 103, 104 constituting the pump are in contact with each other and are also in contact with reservoir 101. In some embodiments, each of the surfaces of the different components enters into close contact with an adjacent surface chat is substantially without gaps or spaces. The relative thickness or volume of the various components depends on the function that the component provides and on the capillary pumping application.

The components constituting the evaporation device 100 according to the present invention described above may be chosen from different materials. Thus, wettable porous components 103, 104 are preferably produced by utilizing poor heat conducting materials such as, for example, sintered glass, glass beads, glass fibers, stainless steel frits or pores. Other exemplary porous materials that may be utilized comprise porous ceramic, such as alumina buffer material (as provided, for example by Abrasives Unlimited Inc., San Leandro, Calif.). Other types of absorbents and/or porous materials comprising cotton, glass fiber (such as NOMEX™ d'E. I. Dupont de Nemours et Cie., Wilmington, Del.) and similar, known by the person skilled in the art, may alternately be utilized. These materials have a maximum thermal conductivity of approximately 0.03 to 3 W/m–K.

Figure 2:
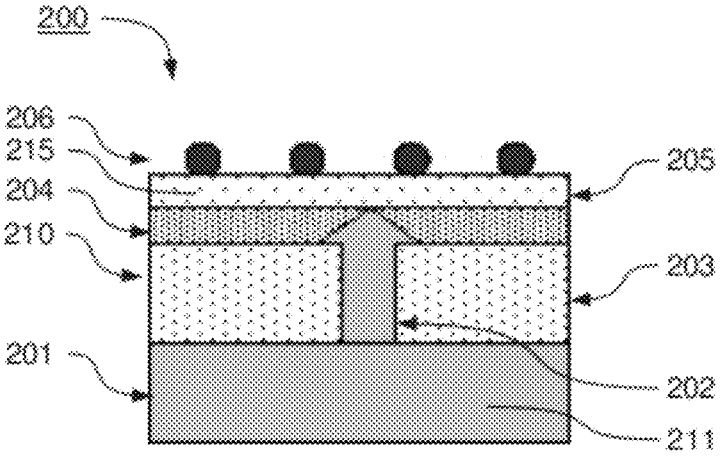
FIG. 2 is a schematic diagram in side view illustrating a device for the vaporization of a liquid to be vaporized comprising a capillary pump according to another embodiment of the present invention.

FIG. 2 shows a cross sectional view of a second embodiment of the invention of an evaporation device 200. The evaporation device 200 is essentially identical to that described in FIG. 1 and comprises a reservoir 201 capable of containing a liquid to be vaporized 211, a capillary pump 210 having a first wettable porous component 203 and a second wettable porous component 204, a heating element 206 and a capillary barrier 205 comprising a non wettable porous component 215. Associated capillary pumping up to the capillary barrier 205 is designated by arrow 202.

The difference between device 200 and device 100 FIG. 1 consists in the arrangement of the non wettable porous component 215 below the heating element 206. In further detail, non wettable porous component 215 is positioned just above the second wettable porous component 204 and between the latter and the heating element 206.

The arrangement according to FIG. 2 enables the heating element 206 to be utilized to mechanically maintain the different layers of evaporation device 200 in the form of disks, established by the different constituent components of device 200, between them. In other words, in the evaporation device 200, the heating element 206 mechanically maintains the reservoir 201, the first wettable porous component 203, the second wettable porous component 204 and the non wettable porous component 205.

Figure 3:
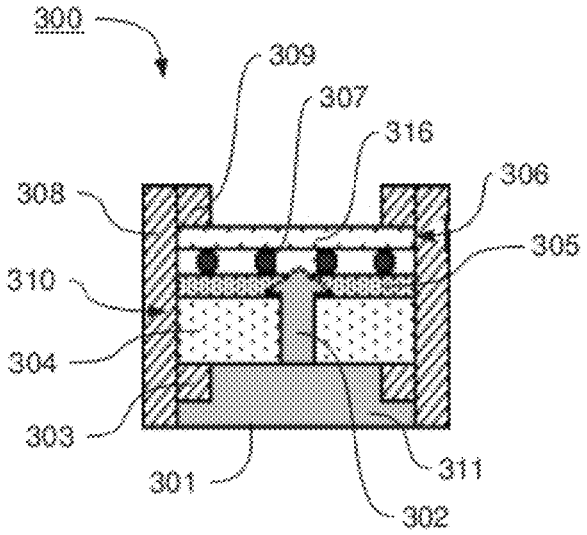
FIG. 3 is a schematic diagram in side view illustrating a device for the vaporization of a liquid to be vaporized comprising a capillary pump according to still another embodiment of the present invention with an assembly of components in disk form.

FIG. 3 shows a cross sectional view of an evaporation device 300 according to a third embodiment of the present invention. Device 300 is constituted of an assembly of materials in stacked disk form, such as illustrated in FIG. 1, and comprises by way of example a reservoir 301 capable of containing a liquid to be vaporized 311. Reservoir 301 is arranged in an adjacent manner with relation to a capillary pump 310 having a first wettable and thermally insulating porous medium 304, itself arranged in an adjacent manner with relation to a second wettable and thermally insulating porous medium 305. The capillary pump 310 is arranged below a heating element 307 that is covered by a non wettable porous component 316 producing a capillary barrier 306. Associated capillary pumping up to the capillary barrier 306 is designated by arrow 302.

The assembly is maintained by a support 308. The latter comprises an upper annular support 309 (illustrated in FIG. 3 on the right and left sides of the device 300 above the non wettable porous component 316) and a lower annular support 303 (illustrated at the bottom of FIG. 3 between the reservoir 301 and the first wettable porous component 304.

Figure 4:
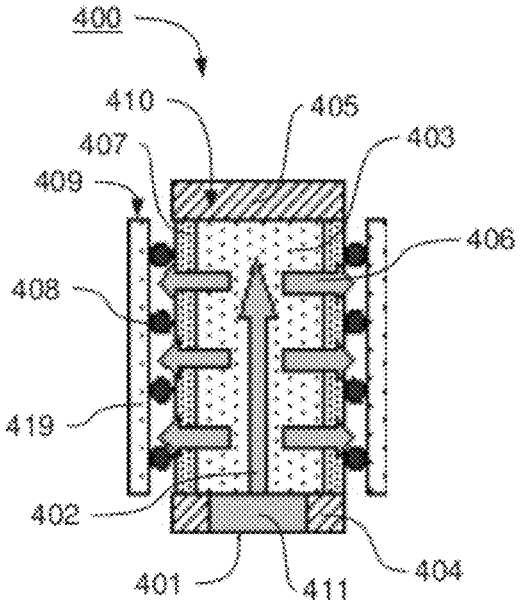
FIG. 4 is a schematic diagram in side view illustrating a device for the vaporization of a liquid to be vaporized comprising a capillary pump according to still another embodiment of the present invention with an assembly of components with a cylindrical geometry.

FIG. 4 shows a cross sectional view of an evaporation device 400 according to a fourth embodiment of the present invention. Device 400 is constituted of an assembly of materials and components according to a cylindrical geometry and comprises by way of example a reservoir 401 capable of containing a liquid to be vaporized 411, a capillary pump 410 with a first wettable and thermally insulating porous component 403 and a second wettable and thermally insulating component 407, a heating element 408 and a capillary barrier 409, that comprises by way of example a non wettable porous component 419. Associated capillary pumping up to capillary barrier 409 is designated by arrows 402 and 406.

The first wettable porous component 403 has a cylindrical shape and is maintained with the cylindrical reservoir 401 by an annular support 404, and a disk-shaped support 405. In further detail, at the bottom of FIG. 4, reservoir 401 is maintained by support 404, that has an annular configuration and illustratively surrounds the end of reservoir 401. At the top of FIG. 4, the first wettable porous component 403 is covered by the disk-shaped support 405.

In addition, the first wettable porous component 403 is surrounded by the second wettable porous component 407 having, by way of example, a tube shape and is also maintained by support 404, 405. The second wettable porous component 407 is surrounded by the heating element 408, provided in a spiral shape and may be used to maintain the arrangement of FIG. 4 according to a cylindrical geometry. Lastly, heating element 408 is surrounded by the non wettable porous component 419 in tube shape.

Figure 5:
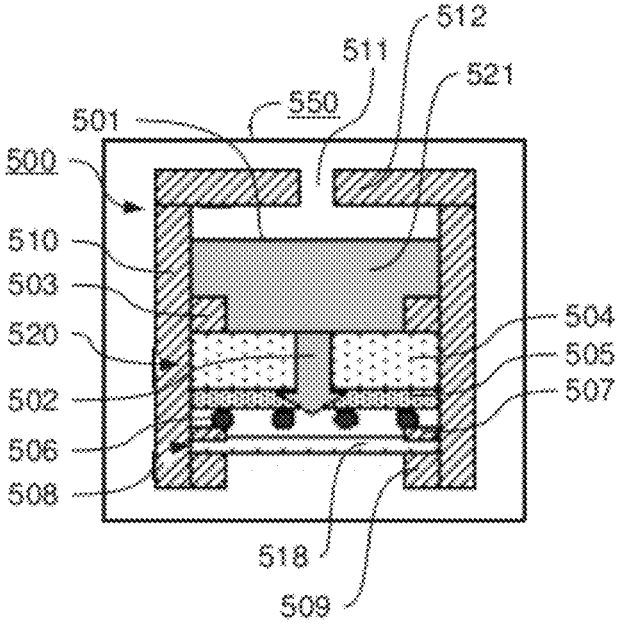
FIG. 5 is a schematic diagram in side view illustrating a particle analysis system comprising a device for the vaporization of a liquid to be vaporized according to the present invention.

FIG. 5 shows a cross sectional view of a particle analysis system 550 comprising an evaporation device 500 according to a fifth embodiment of the present invention. Device 500 is constituted of an assembly of materials in the form of stacked disks, such as illustrated in FIG. 3, but in comparison with FIG. 3, turned the other way.

Device 500 comprises, by way of example, a reservoir 501 capable of containing a liquid to be vaporized 521, the reservoir 501 being arranged in FIG. 5 above a first wettable and thermally insulating porous component 504, that is itself arranged in FIG. 5 above a second wettable and thermally insulating porous component 505. The two wettable porous components 504, 505 produce for the illustration a capillary pump 520, arranged in FIG. 5 above a heating element 506 preferably provided in grid form.

Reservoir 501, the first and second wettable porous components 504, 505 and the heating element 506 are maintained by a support 510. The latter comprises a first lower annular support 509 and a second lower annular support 507 in flange form (illustrated in FIG. 5 on the right and left sides of device 500 below heating element 506), a middle annular support 503 (illustrated at the middle of FIG. 5 between reservoir 501 and the first wettable porous component 504) and an upper annular support 512 having an opening 511 and being put or fixed on device 500 as a cover.

The second symmetrical lower support 507 is provided to maintain reservoir 501, the first and second wettable porous components 504, 505 and the heating element 506 in stacked disk form, as illustrated in FIG. 3. Between this second symmetrical lower support 507 and the first symmetrical lower support 509 is provided a non wettable porous component 518 that is removable, forming a capillary barrier 508. Associated capillary pumping up to the capillary barrier 508 is designated by an arrow 502.

According to an embodiment, the first symmetrical lower support 509 is removable and enables easy and quick replacement and/or cleaning of the removable, non wettable porous component 518, while the other components are maintained during these component 518 replacement and/or cleaning operations by the second symmetrical lower support 507. As mentioned above and seen in FIG. 5, the non wettable porous component 518 is situated inside the analysis system 550 and is in contact with the air to be treated. Thus, to eliminate the risk of contamination of device 500, the non wettable porous component 518 is changeable and/or cleanable between two analyses.

The present invention was described above in detail relating to specific modes of embodiment and production with relation to the attached figures. These specific modes should not be interpreted as limitations of the scope of the invention, but as exemplary modes of embodiment and production. It should be noted that modifications and substitutions may be made to the devices for vaporizing a liquid to be vaporized, as well as to processes of their utilization, without departing from the scope of the invention.

Examples

Description of an Embodiment

The invention may for example be produced by stacking various components, mentioned above with reference to FIG. 1, in a support that is both thermally and electrically insulating, capable of withstanding a temperature of utilization greater than 100° C. By way of example, a support comprising polycarbonate may be produced, withstanding temperatures of utilization up to approximately 130° C. max.

In an example of production, the first wettable porous component 103 is constituted of sintered glass of 1 mm thickness and a porosity of approximately 100 to 200 μm. The second wettable porous component 104 is constituted of a filtration membrane in thick glass fiber of 260 μm having a filtration threshold of 1.6 μm. Heating element 105 is a metal screen constituted of stainless steel wires of 97 μm in diameter, and spaced by a distance approaching this diameter. These stainless steel wires are crossed by an electric current and thus constitute the heating element 105. The non wettable porous component 116 is constituted of a Teflon filtration membrane having a filtration threshold of 20 μm. The membranes employed may be for example commercially available filters. Their diameters commonly are 25, 47 or 90 mm. The diameter of the evaporation devices is generally between and 20 cm, and their height is between 2 and 20 cm.

The invention claimed is:

1. A device for vaporization of a liquid, said device comprising:

(i) a reservoir to contain the liquid to be vaporized;

(ii) a heating element to heat the liquid in order to vaporize the liquid;

(iii) a capillary pump to pump the liquid contained in said reservoir to said heating element by capillary pumping; and (iv) a capillary barrier arranged along a capillary pumping direction of the liquid to be vaporized downstream from the capillary pump;

wherein the capillary barrier comprises at least one non wettable porous component which is impermeable to the liquid to be vaporized and permeable to a vapor generated from the liquid to be vaporized to prevent the liquid to be vaporized from escaping from the device independently of an orientation of the device; and the heating element is arranged in the capillary pumping direction of the liquid to be vaporized between the capillary pump and the capillary barrier.

2. The device according to claim 1, in which said at least one non wettable porous component comprises a membrane in a polymer material.

3. The device according to claim 1, in which said at least one non wettable porous component is a comparatively poor conductor of the heat required for the vaporization of said liquid to be vaporized.

4. The device according to claim 3, in which said at least one non wettable porous component is adapted to withstand temperatures greater than 100° C.

5. A device for the vaporization of a liquid, the device comprising:

(i) a reservoir to contain the liquid to be vaporized;

(ii) a heating element to heat the liquid in order to vaporize the liquid;

(iii) a capillary pump to pump the liquid contained in the reservoir to the heating element by capillary pumping; and (iv) a capillary barrier arranged along a capillary pumping direction of the liquid to be vaporized downstream from the capillary pump;

wherein the capillary barrier comprises at least one non wettable porous component, which is impermeable to the liquid to be vaporized and permeable to a vapor generated from the liquid to be vaporized, to prevent the liquid to be vaporized from escaping from the device independently of an orientation of the device; and the at least one non wettable porous component is a comparatively poor conductor of the heat required for the vaporization of the liquid to be vaporized and comprises a thermally insulating material.

6. A device for the vaporization of a liquid, the device comprising:

(i) a reservoir to contain the liquid to be vaporized;

(ii) a heating element to heat the liquid in order to vaporize the liquid;

(iii) a capillary pump to pump the liquid contained in said reservoir to the heating element by capillary pumping; and (iv) a capillary barrier arranged along a capillary pumping direction of the liquid to be vaporized downstream from the capillary pump;

wherein the capillary barrier comprises at least one non wettable porous component which is impermeable to the liquid to be vaporized and permeable to a vapor generated from the liquid to be vaporized to prevent the liquid to be vaporized from escaping from the device independently of an orientation of the device; and the capillary barrier is arranged in a removable manner.

7. The device according to claim 1, in which said reservoir, said capillary pump and said capillary barrier are provided in a form of stacked disks.

8. The device according to claim 1, in which at least said capillary pump is provided in cylindrical form and said capillary barrier is provided in annular form, said capillary barrier at least partially surrounding said capillary pump.

9. The device according to claim 1, in which said reservoir, said capillary pump and said capillary barrier are arranged in an external support.

10. The device according to claim 9, in which said external support comprises glass, ceramic and/or plastic adapted to withstand the heat required for the vaporization of said liquid to be vaporized.

11. The device according to claim 1, in which said heating element comprises at least one unoxydizable material.

12. The device according to claim 1, in which said heating element is arranged in a direction of capillary pumping of said liquid to be vaporized between said capillary pump and said capillary barrier.

13. The device according claim 1, in which said heating element is arranged in a direction of capillary pumping of said liquid to be vaporized downstream from said capillary barrier.

14. The device according to claim 1, in which said heating element provided in a form of an electrically conductive grid.

15. The device according to claim 1, in which said capillary pump comprises at least one wettable porous component permeable to said liquid to be vaporized.

16. The device according to claim 15, in which a porosity of said at least one non wettable porous component is higher than a porosity of said at least one wettable porous component.

17. The device according to claim 15, in which said at least one wettable porous component is equipped with a porosity gradient, or comprises at least one first porous component and one second porous component, a porosity of said first porous component being higher than a porosity of said second porous component.

18. The device according to claim 5, wherein the at least one non wettable porous component comprises a membrane in a polymer material.

19. The device according to claim 18, in which the at least one non wettable porous, component is adapted to withstand temperatures greater than 100° C.

20. The device according to claim 19, wherein the capillary barrier arranged in a removable manner.

* * * * *